US005904812A

United States Patent [19]

Salman et al.

[11] Patent Number: 5,904,812

[45] Date of Patent: May 18, 1999

[54] CALENDERED AND EMBOSSED TISSUE PRODUCTS

[75] Inventors: Zeinab Salman, Neenah; Richard Douglas Jennings, Appleton, both of Wis.

[73] Assignee: Kimberly-Clark Worldwide, Inc., Neenah, Wis.

[21] Appl. No.: 08/876,547

[22] Filed: Jun. 16, 1997

[51] Int. Cl.[6] ..... D21G 1/00; D21F 11/00

[52] U.S. Cl. ..... 162/117; 162/109; 162/113; 162/205; 162/361; 100/38; 100/195; 428/211; 428/361

[58] Field of Search ..... 162/109, 113, 162/116, 117, 118, 205, 210, 204, 361, 206, 207, 362; 100/38, 194, 195, 137, 331, 163 A, 162 B; 428/209, 211, 361

[56] References Cited

U.S. PATENT DOCUMENTS

| | | | |
|---|---|---|---|
| 361,849 | 4/1887 | Taylor . | |
| 1,541,977 | 6/1925 | Lorenz . | |
| 1,548,790 | 8/1925 | Lorenz . | |
| 3,266,416 | 8/1966 | Mittman | 101/32 |
| 3,608,047 | 9/1971 | Wiggins | 264/286 |
| 3,714,687 | 2/1973 | van Tilburg | 28/272.1 |
| 4,135,024 | 1/1979 | Callahan | 428/171 |
| 4,208,459 | 6/1980 | Becker et al. | 428/154 |
| 4,230,036 | 10/1980 | Groome | 100/35 |
| 4,236,963 | 12/1980 | Busker | 162/271 |
| 4,257,843 | 3/1981 | Watanabe et al. | 162/146 |
| 4,300,981 | 11/1981 | Carstens | 162/109 |
| 4,557,778 | 12/1985 | Held | 156/209 |
| 4,803,032 | 2/1989 | Schulz | 264/284 |
| 4,960,046 | 10/1990 | Anstötz et al. | 100/93 RP |
| 5,091,032 | 2/1992 | Schulz | 156/219 |
| 5,126,015 | 6/1992 | Pounder | 162/206 |
| 5,223,092 | 6/1993 | Grinnell et al. | 162/109 |
| 5,269,983 | 12/1993 | Schulz | 364/25 |
| 5,314,584 | 5/1994 | Grinnell et al. | 162/109 |
| 5,356,364 | 10/1994 | Veith et al. | 493/395 |
| 5,383,778 | 1/1995 | Schulz | 425/363 |
| 5,409,572 | 4/1995 | Kershaw et al. | 162/109 |
| 5,468,323 | 11/1995 | McNeil | 156/209 |
| 5,490,902 | 2/1996 | Schulz | 162/109 |
| 5,503,896 | 4/1996 | Veith et al. | 428/141 |
| 5,510,001 | 4/1996 | Hermans et al. | 162/113 |
| 5,529,563 | 6/1996 | Veith et al. | 493/395 |
| 5,597,639 | 1/1997 | Schulz | 428/156 |
| 5,609,098 | 3/1997 | Abe et al. | 100/331 |
| 5,620,776 | 4/1997 | Schulz | 428/156 |
| 5,656,134 | 8/1997 | Marinack et al. | 162/109 |
| 5,693,403 | 12/1997 | Brown et al. | 428/153 |

FOREIGN PATENT DOCUMENTS

| | | | |
|---|---|---|---|
| 0 495 637 A1 | 7/1992 | European Pat. Off. | D21H 25/00 |

OTHER PUBLICATIONS

Tappi Official Test Method T 402 om–93, "Standard Conditioning and Testing Atmospheres For Paper, Board, Pulp Handsheets, and Related Products," published by the Tappi Press, Atlanta, Georgia, revised 1993, pp. 1–3.

Tappi Official Test Method T 411 om–89, "Thickness (Caliper) of Paper, Paperboard, and Combined Board," published by the Tappi Press, Atlanta, Georgia, revised 1989, pp. 1–3.

*Primary Examiner*—Stanley S. Silverman
*Assistant Examiner*—José A. Fortuna
*Attorney, Agent, or Firm*—Thomas J. Connelly

[57] ABSTRACT

High bulk tissue webs are processed sequentially through separate calendering and embossing units to optimize the balance between sheet caliper for winding tension and embossing element height for pattern definition, resulting in embossed, high-bulk tissue products with improved embossing pattern clarity. The multiple step converting process enables the use of male embossing elements having a height of about 0.04 inch or greater. The tissue webs have a Residual Waviness value of 12 micrometers or greater, which is attributable to average surface waviness values for the spot embossments being about 30 micrometers or greater.

10 Claims, 4 Drawing Sheets

CALENDERED AND EMBOSSED TISSUE PRODUCTS

BACKGROUND OF THE INVENTION

The present invention relates to tissue products. More particularly, the invention concerns calendered and embossed tissue products.

There is a recognized desire to create tissue products, particularly rolled tissue products, with enhanced sheet caliper or thickness. Consumers perceive that tissue products with greater sheet caliper are more absorbent and higher quality than otherwise comparable sheets with less caliper.

Embossing is a well-known mechanism to increase sheet caliper, and it also provides an additional benefit by imparting a decorative pattern to the tissue product. These decorative patterns are commonly formed by "spot embossing", which involves discrete embossing elements that are about 0.5 inch by 0.5 inch to about 1 inch by 1 inch in size, and thus from about 0.25 to about 1 square inch in surface area. These discrete embossing elements are typically spaced about 0.5 inch to about 1 inch apart. The spot embossing elements are formed on a pattern roll, which is also referred to as an embossing roll, and are pressed into the tissue sheet.

In addition to increasing sheet caliper, there is also a desire to create rolled tissue products having a greater number of individual sheets per roll. Rolls with a greater number of sheets are desired by consumers because the rolls need to be replaced less frequently.

Nevertheless, the ability of tissue manufacturers to simultaneously increase both sheet caliper and the number of sheets per roll is limited by the size of existing tissue dispensers. Rolls of bathroom tissue, for instance, typically need a roll diameter no greater than about 5 inches in order to fit into conventional dispensers. Particularly for household purposes, the size of dispensers cannot be enlarged because of both aesthetic and practical considerations.

For rolls of embossed tissue having a given diameter, such as 5 inches, the efforts to maximize both sheet caliper and sheet count have resulted in a relatively high tension within the wound roll. This high in-wound tension is disadvantageous because the decorative embossing pattern tends to be distorted and/or pulled out.

Because the decorative effects of the embossing pattern are an important factor in the desirability of the product, tissue manufacturers have taken steps to retain the embossing pattern clarity. One approach has been to reduce the height of the embossing elements. While this approach has proven to be successful, the reduced element height limits the pattern definition that may be achieved. Therefore, what is lacking and needed in the art is a rolled tissue product that has relatively high bulk, relatively high number of sheets per roll, and improved embossing pattern clarity.

SUMMARY OF THE INVENTION

It has now been discovered that high-bulk tissue products can be embossed with improved pattern clarity by a multiple step converting process. The high bulk tissue webs are processed sequentially through separate calendering and embossing units. While calendering has traditionally been used to reduce sheet thickness and embossing has been used to increase sheet thickness, Applicants have discovered that this multiple step converting process provides a method of optimizing the balance between sheet caliper for winding tension and embossing element height for pattern definition. The result is an embossed, high-bulk tissue product with improved embossing pattern clarity.

The term "pattern definition" as used herein refers to the extent to which the embossed pattern can be immediately identified by distinct impressions made by the embossing element. The term "pattern clarity" as used herein refers to the clearness of the pattern in the final product.

In one aspect, the invention resides in a method for processing a high-bulk throughdried tissue web to form an embossed, rolled tissue product. The method comprises the steps of passing a throughdried tissue web having an initial caliper of about 0.008 inch or greater through a calendering nip formed by a smooth roll and a resilient roll. The resilient calendering roll has a Shore A surface hardness of about 75 to about 100 Durometer. Thereafter the tissue web passes through an embossing nip formed between a pattern roll and a backing roll, after which the tissue web is rewound to form an embossed, rolled tissue product such as bath tissue.

The multiple step converting process enables the independent embossing process to incorporate male embossing elements that have a relatively large height dimension, measured from the surrounding land areas. In particular, the height of the male embossing elements can be about 0.04 inch or greater, such as from about 0.045 to about 0.06 inch, for example about 0.045 inch for improved performance.

The spaced-apart discrete spot embossing elements or embossments can depict flowers, leaves, birds, animals, and the like. These embossing elements or embossments, taken as a whole, are referred to herein as "spot embossing elements" or "spot embossments". They are generally about 0.5 inch or greater in size, and about 0.25 to about 1 square inch in area. The spot embossing elements are typically spaced apart about 0.5 to about 1 inch on the tissue sheet. These spot embossing elements generally consist of several individual line segments which are referred to as individual embossing elements or embossments.

In another aspect, the invention resides in a rolled tissue product comprising a tissue web formed with spot embossments separated by land areas. The tissue web has a caliper of about 0.008 inch or greater, a bulk of about 6 cubic centimeters per gram or greater, and a Residual Waviness of 12 micrometers or greater. Further, the average surface waviness for the spot embossments is about 30 micrometers or greater, and the length of the tissue web within the roll is from about 45 to about 120 meters.

The term "caliper" refers to the thickness of a single sheet, but measured as the thickness of a stack of ten sheets and dividing the ten sheet thickness by ten, where each sheet within the stack is placed with the same side up. Caliper is typically expressed in inches or microns. It is measured in accordance with TAPPI test methods T402 "Standard Conditioning and Testing Atmosphere For Paper, Board, Pulp Handsheets and Related Products" and T411 om-89 "Thickness (caliper) of Paper, Paperboard and combined Board" with Note 3 for stacked sheets. The micrometer used for carrying out T411 om-89 is a Bulk Micrometer (TMI Model 49-72-00, Amityville, N.Y.) having an anvil pressure of 220 grams/square inch (3.39 kiloPascals).

After the caliper is measured, the same ten sheets in the stack are used to determine the average basis weight of the sheets. The average basis weight of a single sheet is the measured weight of the stack of ten sheets divided by the surface area of a sheet and divided by 10. The basis weight is typically expressed in pounds per 2880 square feet.

The term "bulk" refers to the basis weight of a single sheet divided by its caliper. Bulk is typically expressed in grams per cubic centimeter (g/cc).

The "Residual Wavinessz", which is used to quantify the crispness or quality of the embossments in the tissue, is defined as the difference between average surface waviness (hereinafter defined) of the tissue surface occupied by the spot embossments and the average surface waviness of the immediately adjacent unembossed surface (land area). This difference is termed Residual Waviness (RW), which is a measure of the embossment quality attributable to the invention. Units of RW are in micrometers. For roll products, RW is measured on tissue sheets positioned within the roll 0.5 inch from the outside of the core of the roll. To the extent that winding tension adversely impacts the quality of the embossments, it is apparent from sheets located at this position within the roll.

The tissue products of the present invention have been found to have surprisingly high Residual Waviness values. In particular, the RW values of tissue products according to this invention are about 12 micrometers or greater, particularly about 14 micrometers or greater, such as from about 14 to about 16 micrometers.

The multiple step converting process in combination with the relatively large embossing element heights provide for greater pattern definition. For purposes of the present invention, this feature can be characterized by the average surface waviness of the tissue surface occupied by the spot embossments. In particular, the average surface waviness for the spot embossments may be about 30 micrometers or greater, more particularly about 32 micrometers or greater, such as approximately 34 micrometers or greater.

The average surface waviness (sWa) for any portion of the tissue surface is defined as the equivalent of the universally recognized common parameter describing average surface roughness of a single traverse, Ra, applied to a surface after application of a waviness cut-off filter. It is the arithmetic mean of departures of the surface from the mean datum plane calculated using all measured points. The mean datum plane is that plane which bisects the data so that the profile area above and below it are equal.

A waviness filter of 0.25 millimeter cut-off length is a computer method of separating (filtering) structural features spaced above this wavelength from those less than this wavelength, and is defined in surface metrology as a "low-pass" filter. The spot embossment elements consist of widths approximating 1 millimeter in width on the tissue. This waviness filter passes 100 percent of structures at this wavelength more or less corresponding to embossment features apparent to the unaided eye, while suppressing 100 percent of features whose wavelength equals or is less than 25 micrometers, that being typical width dimensions of individual softwood pulp fibers comprising the tissue.

Average surface waviness (sWa) data necessary for calculation of RW are obtained using a Form Talysurf Laser Interferometric Stylus Profilometer (Rank Taylor Hobson Ltd., P.O. Box 36, New Star Rd., Leicester LE4 7JQ, England). The stylus used is Part # 112/1836, diamond tip of nominal 2-micrometer radius. The stylus tip is drawn across the sample surface at a speed of 0.5 millimeters/sec. The vertical (Z) range is 6 millimeters, with vertical resolution of 10.0 nanometers over this range. Prior to data collection, the stylus is calibrated against a highly polished tungsten carbide steel ball standard of known radius (22.0008 mm) and finish (Part # 112/1844 [Rank Taylor Hobson, Ltd.]). During measurement, the vertical position of the stylus tip is detected by a Helium/Neon laser interferometer pick-up, Part # 112/2033. Data is collected and processed using Form Talysurf Ver. 5.02 software running on an IBM PC compatible computer.

To determine the RW for a particular tissue sample, a portion of the tissue is removed with a single-edge razor or scissors (to avoid stretching the tissue) which includes the spot embossment and adjacent land area. The tissue is attached to the surface of a 2 inch×3 inch glass slide using double-side tape and lightly pressed into uniform contact with the tape using another slide.

The slide is placed on the electrically-operated, programmable Y-axis stage of the Profilometer. For purposes of measuring a typical embossment, for example, the Profilometer is programmed to collect a "3D" topographic map, produced by automatically datalogging 256 sequential scans in the stylus traverse direction (X-axis), each 20 millimeters in length. The Y-axis stage is programmed to move in 78 micrometer increments after each traverse is completed and before the next traverse occurs, providing a total Y-axis measurement dimension of 20 millimeters and a total mapped area measuring 20×20 millimeters. With this arrangement, data points each spaced 78 micrometers apart in both axes are collected, giving the maximum total 65,536 data points per map available with this system. The process is repeated for the adjacent land area. Because the equipment can only scan areas which are rectangular or square, for purposes of measuring RW, the area of the tissue occupied by the spot embossment is the area defined by the smallest rectangle or square which completely encompasses the spot embossment being measured. In measuring the cotton ball spot embossment as described in relation to FIG. 2, a 23.9×23.9 millimeter square field was appropriate, but the size and shape of the field will be different for different spot embossments. For the land areas, the largest square that could fit between the cotton ball embossments was a 17×17 millimeter square field.

The resultant "3D" topological map, being configured as a ".MAP" computer file consisting of X-, Y- and Z-axis spatial data (elevation map), is reconstructed for analysis using Talymap 3D Ver. 2.0 software Part# 112/2403 (Rank Taylor Hobson, Ltd.) running on an Apple Quadra 650 computer platform. The average surface waviness (sWa) parameter is derived using the following procedures: a) leveling the map plane using a least squares fit function to remove sample tilt due to error in horizontal positioning of the tissue; b) application of a waviness filter of 0.25 millimeters cut-off length to the surface data, and resultant reconstruction of the surface map; and c) requesting the sWa parameter from this filtered surface. The measurement of sWa is repeated three times, each measurement from different areas, to obtain separate mean sWa values for the embossment and the surrounding land area. The difference between the mean sWa values for the embossment area and the land area is the RW for the embossment. The average RW for the roll of tissue is determined by averaging the embossment RW values for at least three randomly selected spot embossments. Similarly, the mean sWa values for the land areas surrounding the selected embossments can be averaged for the same three or more samples to obtain an average land area sWa for the sample.

For purposes herein, a "tissue web" or "tissue sheet" is a cellulosic web suitable for making or use as a facial tissue, bath tissue, paper towels, napkins, or the like. It can be layered or unlayered, creped or uncreped, and can consist of a single ply or multiple plies. In addition, the tissue web can contain reinforcing fibers for integrity and strength. Tissue webs suitable for use in accordance with this invention are characterized by being absorbent, of low density and relatively fragile, particularly in terms of wet strength. Densities are typically in the range of from about 0.1 to about 0.3 grams per cubic centimeter. Absorbency is typically about 5 grams of water per gram of fiber, and generally from about 5 to about 9 grams of water per gram of fiber. Wet tensile strengths are generally about 0 to about 300 grams per inch of width and typically are at the low end of this range, such as from about 0 to about 30 grams per inch. Dry tensile strengths in the machine direction can be from about 100 to about 2000 grams per inch of width, preferably from about 200 to about 350 grams per inch of width. Tensile strengths in the cross-machine direction can be from about 50 to about 1000 grams per inch of width, preferably from about 100 to about 250 grams per inch of width. Dry basis weights are generally in the range of from about 5 to about 60 pounds per 2880 square feet. The tissue webs referred to above are preferably made from natural cellulosic fiber sources such as hardwoods, softwoods, and nonwoody species, but can also contain significant amounts of recycled fibers, sized or chemically-modified fibers, or synthetic fibers.

Tissue sheets which particularly benefit from the method of this invention are premium quality tissue sheets which have a relatively high degree of resiliency and low stiffness, such as throughdried tissue sheets. Such tissue sheets can be creped or uncreped. The basis weight of the tissue sheet can be from about 5 to about 70 grams per square meter. Although the method of this invention can be effective for wet-pressed tissue sheets, the benefits are not as pronounced relative to conventional embossing because wet-pressed sheets have a lower caliper and higher stiffness than throughdried sheets and therefore have better embossing pattern retention.

For bath tissue, the size of the rolls is from about 4.5 to about 5.5 inches in diameter. The overall roll length can be from about 45 to about 120 meters, and more particularly from about 50 to about 95 meters. The number of individual perforated sheets within the roll can be from about 500 to about 900, such perforated sheets typically being about 4.5 inches long.

A measure of the firmness of the tissue rolls can be characterized by a "Firmness Index," which is described in U.S. Pat. No. 5,356,364 issued Oct. 18, 1994 to Veith et al. entitled "Method For Embossing Webs", which is hereby incorporated by reference. Because of the manner in which the Firmness Index is measured, higher numbers mean lower roll firmness. Specifically, the Firmness Index values for certain tissue rolls as described herein can be from about 0.115 inch to about 0.215 inch, and more specifically from about 0.140 inch to about 0.190 inch.

The "Stiffness Factor" for the tissue sheet within the roll is calculated by multiplying the MD Max Slope (hereinafter defined) by the square root of the quotient of the caliper, divided by the number of plies. The MD Max Slope is the maximum slope of the machine direction load/elongation curve for the tissue. The units for MD Max Slope are kilograms per 3 inches (7.62 centimeters). The units for the Stiffness Factor are (kilograms per 3 inches)-microns$^{0.5}$. The Stiffness Factor for tissue sheets that are calendered and embossed in accordance with this invention can be about 100 or less, suitably from about 50 to about 100, and preferably about 75 or less.

DETAILED DESCRIPTION OF THE DRAWINGS

Figure 1:
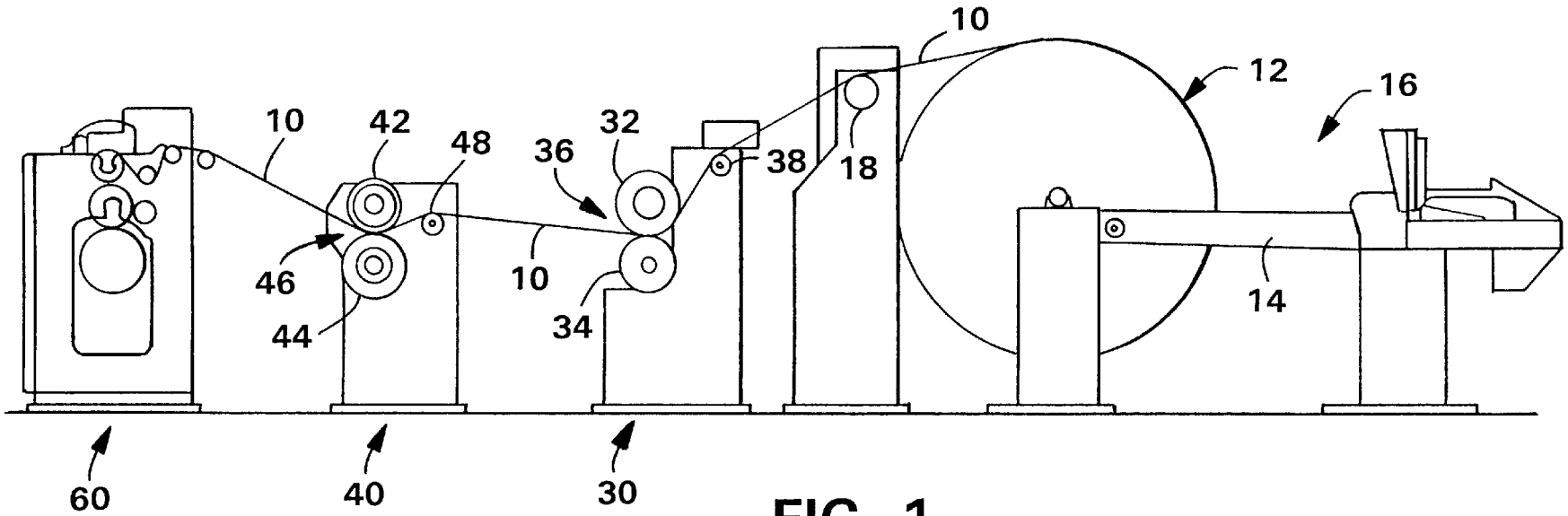
FIG. 1 is a schematic process flow diagram for a method of making a calendered and embossed, rolled tissue product in accordance with this invention.

A method for carrying out the present invention is shown in greater detail in the process flow diagram of FIG. 1. A tissue web 10 as would be produced by a tissue manufacturing machine is unwound from a parent roll 12 in a conventional manner. The parent roll 12 is shown resting on kitchen rails 14 in a parent roll staging area 16. A driven spreader roll 18 is used to unwind the tissue web 10.

The unwound tissue web 10 is transported to a calendering unit 30 comprising a pair of calendering rolls 32 and 34. The calendering rolls 32 and 34 together define therebetween a calendering nip 36. A spreader roll 38 is shown preceding the calendering nip 36, although other details of the calendering unit 30 are not shown for purposes of clarity.

The calendering nip 36 is desirably a "soft nip" wherein the rolls have different surface hardnesses and at least one of the rolls has a resilient surface. Resilient calendering rolls suitable for the present invention are typically referred to as rubber covered calendering rolls, although the actual material may comprise natural rubber, synthetic rubber, composites, or other compressible surfaces. Suitable resilient calendering rolls may have a Shore A surface hardness of about 75 to about 100 Durometer, (approximately 0 to 55 Pusey & Jones), and particularly from about 85 to about 95 Durometer (approximately 10 to 40 Pusey & Jones). The calendering nip pressure is suitably from about 30 to about 200 pounds per lineal inch, and more particularly from about 75 to about 175 pounds per lineal inch.

In one particular embodiment, the calendering rolls 32 and 34 comprise a smooth steel roll 34 and a smooth resilient roll 32 formed of a composite polymer such as that available from Stowe Woodward Company, U.S.A., under the tradename MULTICHEM, with a Shore A surface hardness of about 90 Durometer (approximately 25–30 Pusey & Jones). Further, as disclosed in copending U.S. Pat. application Ser. No. unassigned, filed on even date herewith by R. Jennings et al. and titled "Sheet Orientation For Soft-Nip Calendering And Embossing Of Creped Throughdried Tissue Products", the surface of a throughdried tissue sheet that is disposed toward the throughdrying fabric is desirably placed in contact with the resilient calendering roll when the sheet passes through the calendering nip.

The caliper of the tissue web 10 prior to the calendering nip, referred to as the initial caliper, is suitably about 0.008 inch or greater, and particularly about 0.01 inch or greater. The post calendering caliper is desirably from about 0.006 to about 0.009 inch, and particularly about 0.008 to about 0.009 inch, with a post calendering bulk of about 6 cubic centimeters per gram or greater.

Upon exiting the calendering unit 30, the tissue web 10 is transported to an embossing unit 40 comprising a pattern roll 42 and a backing roll 44. The pattern and backing rolls 42 and 44 together define therebetween an embossing nip 46. A spreader roll 48 is shown preceding the embossing nip 46, although other details of the embossing unit 40 are not shown for purposes of clarity.

Figure 2:
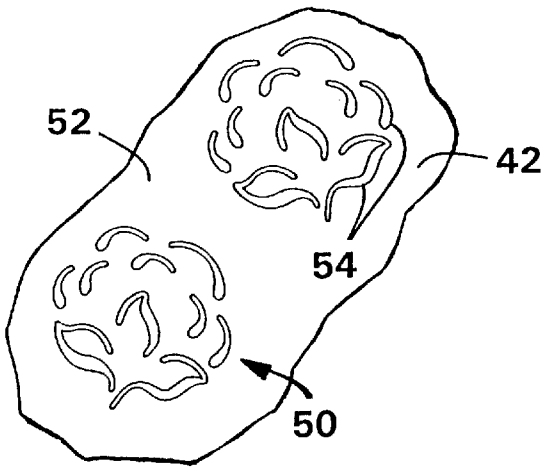
FIG. 2 representatively shows a plan view of a portion of an exemplary pattern roll used in the process illustrated in FIG. 1 to emboss a tissue web with a cotton ball pattern.

A plan view of a portion of the surface of an exemplary pattern roll 42 is shown in FIG. 2. The surface of the pattern roll 42 includes a plurality of discrete male spot embossing elements 50 that are separated by smooth land areas 52. The male spot embossing elements 50 define a decorative pattern, which in the illustrated embodiment is a series of cotton balls. The male spot embossing elements 50 may comprise a plurality of separate embossing element segments 54 which are raised above the surface of the land areas 52. Each cotton ball depicted in FIG. 2 is a spot embossing element 50 comprising ten individual embossing element segments 54. The pattern roll 42 may be formed by engraving or other suitable techniques.

Figure 3:
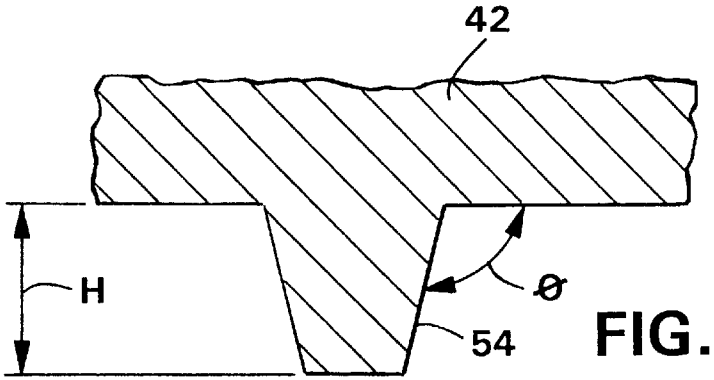
FIG. 3 representatively shows a schematic sectional view of an embossing element of the pattern roll shown in FIG. 2, with various dimensions labeled.

The pattern roll 42 is shown in sectional view in FIG. 3 to show various dimensions of an embossing element segment 54. The male embossing element segment 54 protrudes from the surface of the embossing roll a distance or height H, which may be greater than about 0.04 inch, more particularly greater than about 0.045 inch, such as from about 0.045 inch to about 0.07 inch, for example about 0.045 inch. This relatively large element height enhances the embossing pattern definition. The width of the embossing element at its tip can be from about 0.005 to about 0.50 inch. The sidewall angle, theta, as measured relative to the plane tangent to the surface of the roll at the base of the embossing element, is suitably from about 90 degrees to about 130 degrees.

The backing roll 44 may comprise a smooth rubber covered roll, an engraved roll such as a steel roll matched to the pattern roll, or the like. The bonding nip may be set to a pattern/backing roll loading pressure from about 80 to about 150 pounds per lineal inch, for example, an average about 135 pounds per lineal inch, such that the embossing pattern is imparted to the tissue web 10. The backing roll can be any material that meets the process requirements such as natural rubber, synthetic rubber or other compressible surfaces, and may have a Shore A surface hardness from about 65 to about 85 Durometer, such as about 75 Durometer.

The calendered and embossed tissue web 10 is wound onto tissue roll cores to form logs at a rewinding unit 60. Subsequently the logs are cut into appropriate widths and the resulting individual tissue rolls are packaged (not shown).

EXAMPLES

To illustrate the invention, a number of example tissue products were prepared. Each of the following tissue products was converted from a throughdried and creped tissue sheet having a caliper of 0.010 inch and a basis weight of about 15.2 pounds per 2880 square feet. For each Example, the RW value was calculated using the procedure described above except with one rather than three sWa measurements.

EXAMPLE 1. (COMPARATIVE)

For Example 1, a roll of throughdried and creped tissue as described above was unwound, embossed, rewound and converted into bathroom tissue rolls having a diameter of 5.05 inches and a sheet count of 560. The converting line speed was 2200 feet per minute. The embossing nip was formed by an engraved steel pattern roll and a resilient backing roll. The pattern roll was engraved with the cotton ball spot embossing pattern illustrated in FIG. 2. The height of the embossing elements was 0.25 inch. The smooth resilient backing roll had an exterior covering with a Shore A hardness of 75 Durometer, and the embossing nip was set to a loading pressure of 135 pounds per lineal inch.

The resulting rolls of bath tissue had the following properties: a Residual Waviness of 8.0 micrometers; a mean sWa value for the embossment area of 24.3 micrometers; a mean sWa value for the land area of 16.3 micrometers; and a Firmness Index of 0.115 inch.

EXAMPLE 2. (COMPARATIVE)

For Example 2, a roll of throughdried and creped tissue as described above was slit into narrower rolls for use on a narrower converting line. The narrow tissue sheet was processed in the same manner as described in Example 1, except that the converting line speed was 1000 feet per minute. The pattern and backing rolls had the same characteristics as described in Example 1.

The resulting rolls of bath tissue had the following properties: a Residual Waviness of 8.7 micrometers; a mean sWa value for the embossment area of 23.6 micrometers; a mean sWa value for the land area of 14.9 micrometers; and a Firmness Index of 0.120 inch.

EXAMPLE 3

For Example 3, the narrow rolls described in Example 2 were processed on the narrower converting line in the same manner as described in Example 2, except that a calendering unit was inserted between the unwind and embossing operations, and the height of the male embossing elements was increased to 0.425 inch.

The calendering unit comprised a smooth steel calendering roll and a smooth resilient calendering roll. The resilient calendering roll had an exterior covering formed of a composite polymer with a Shore A hardness of 90 Durometer. The calendering nip was set to a loading pressure of 50 pounds per lineal inch.

The visual quality of the embossing pattern in Example 3 was noticeably improved compared to Examples 1 and 2. The resulting rolls of bath tissue had the following properties: a Residual Waviness of 15.8 micrometers; a mean sWa value for the embossment area of 34.1 micrometers; a mean sWa value for the land area of 18.3 micrometers; and a Firmness Index of 0.142 inch.

Figure 4A:
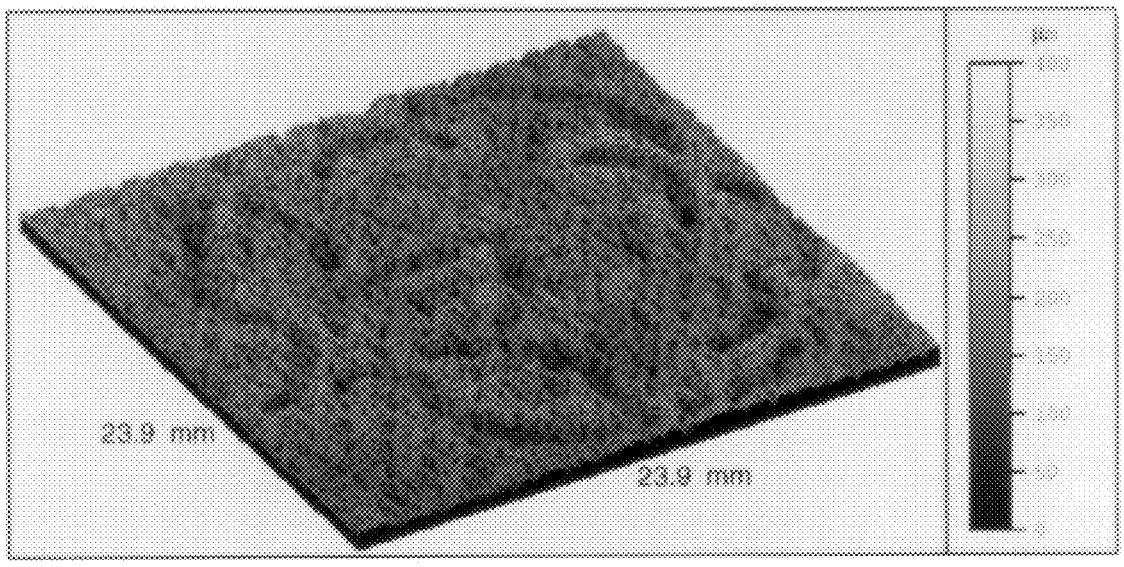
FIGS. 4A and 4B representatively show an oblique wire projection and a wave-filtered elevation map of the average surface waviness (sWa) of the tissue surface occupied by the spot embossments for Example 1, both including a Z-axis scale and the elevation map incorporating a 0.25 millimeter waviness filter applied to the raw map data.
Figure 4B:
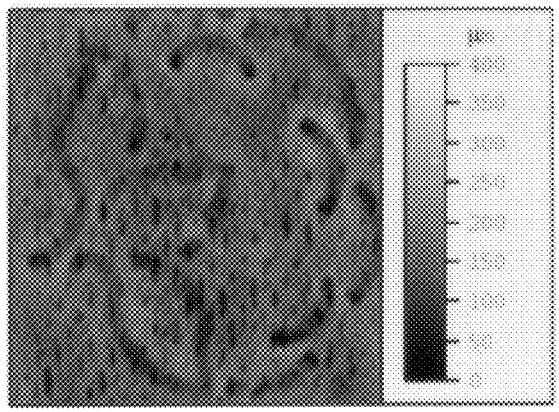
Figure 5A:
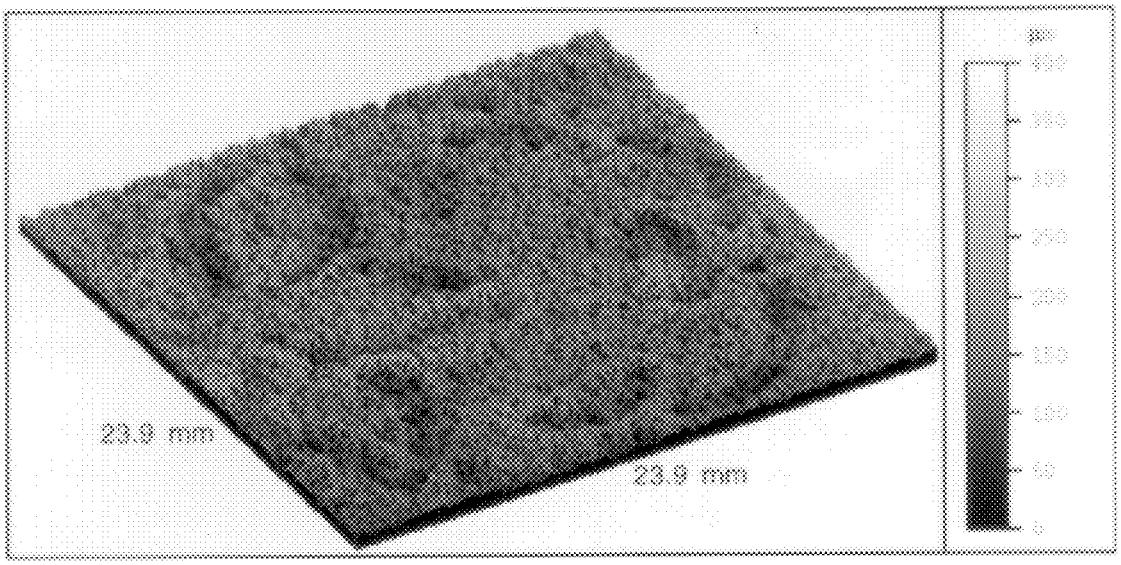
FIGS. 5A and 5B representatively show an oblique wire projection and a wave-filtered elevation map of the average surface waviness (sWa) of the tissue surface occupied by the spot embossments for Example 2, both including a Z-axis scale and the elevation map incorporating a 0.25 millimeter waviness filter applied to the raw map data.
Figure 5B:
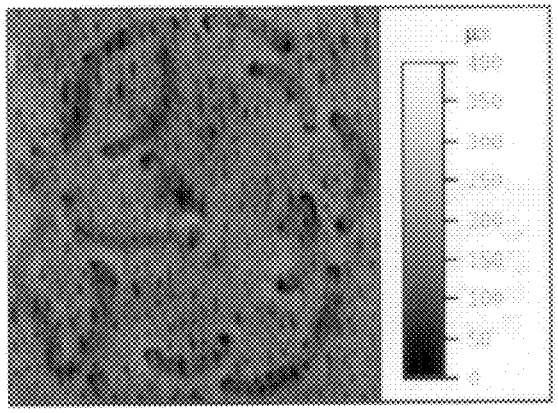
Figure 6A:
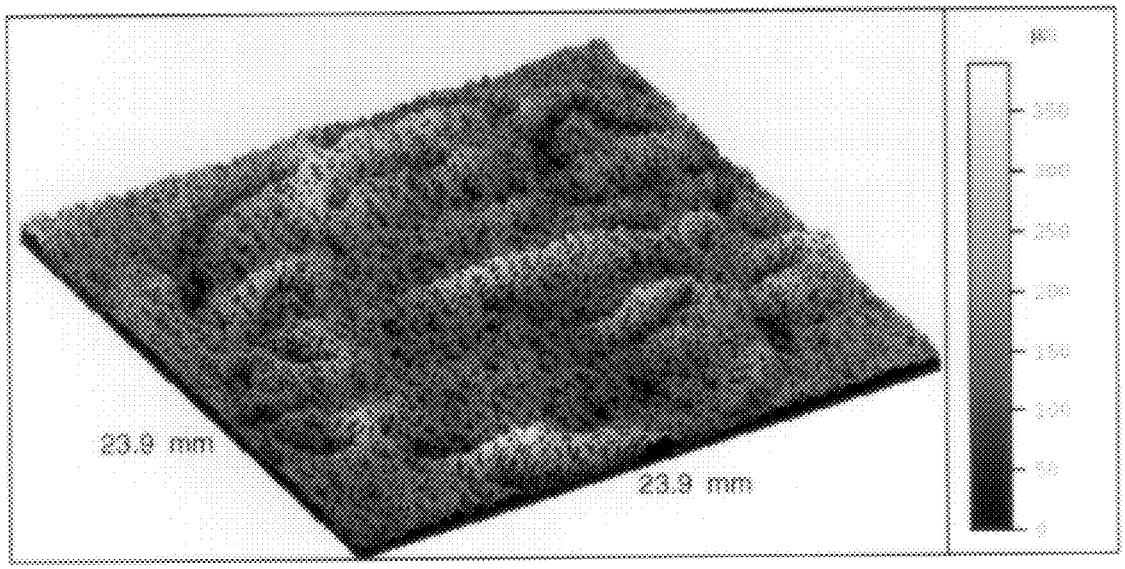
FIGS. 6A and 6B representatively show an oblique wire projection and a wave-filtered elevation map of the average surface waviness (sWa) of the tissue surface occupied by the spot embossments for Example 3, both including a Z-axis scale and the elevation map incorporating a 0.25 millimeter waviness filter applied to the raw map data.
Figure 6B:
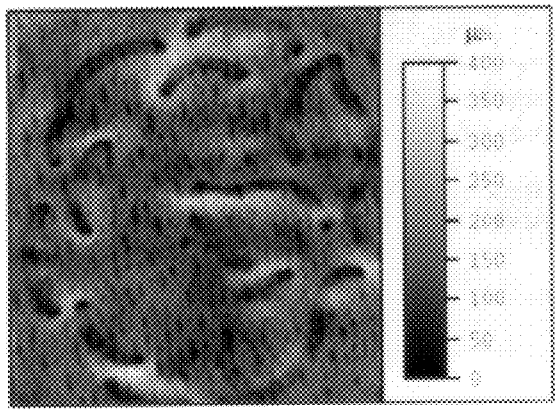

The average surface waviness (sWa) of the tissue surface occupied by the spot embossments for Examples 1–3 are represented by oblique wire projections in FIGS. 4A, 5A and 6A and by elevation maps in FIGS. 4B, 5B and 6B. The elevation maps reflect a 0.25 millimeter waviness filter applied to the raw map data.

Both uncalendered Examples 1 and 2 are similar in topographical appearance, and have similar sWa values for both embossed pattern and land areas. Consequently, their RW values are similar.

The calendered Example 3 tissue had a significantly higher embossed pattern sWa value due to the contribution of irregular high amplitude raised structures at various locations along the edges of the embossment pattern elements. They appear as sharp or protruding ridges in the elevation map and projection. Although high spots are also associated with embossment pattern elements in Examples 1 and 2, they are of much lesser amplitude (note the vertical scales included with the maps). The difference between sWa of the embossed pattern and land areas for Example 3 tissue is therefore large, with concurrent higher RW.

As shown in FIGS. 4–6, the cotton ball embossments of Example 3 were somewhat enlarged relative to those of Examples 1 and 2, presumably due to the calendering process, and were not fully circumscribed in the 23.9×23.9 millimeter square mapping area used to determine RW.

In addition, it is hypothesized that the clarity of the embossing pattern is improved because of an increase in opacity caused by calendering the sheet.

It will be appreciated that the foregoing examples, given for purposes of illustration, are not to be construed as limiting the scope of this invention, which is defined by the following claims and all equivalents thereto.

We claim:

1. A method for processing a high-bulk throughdried tissue web to form an embossed, rolled tissue product, comprising:

a) passing a throughdried tissue web having an initial caliper of about 0.008 inch or greater and a basis weight of from between about 5 to about 70 grams/square meter through a calendering nip formed by a smooth steel roll and a resilient rubber roll, said resilient roll having a Shore A surface hardness of from between about 75 to about 100 Durometer;

b) passing said calendered tissue web through an embossing nip formed between a pattern roll and a smooth rubber covered backing roll, said pattern roll having a surface with a plurality of discrete spot embossing elements separated by smooth land areas, said spot embossing elements including protruding male embossing elements having a height of at least about 0.04 inches and an area of less than 1 square inch, and said tissue web having an average surface waviness for said spot embossments of at least about 30 micrometers; and c) rewinding said tissue web into said rolled tissue product, said tissue product having a diameter of from between about 4.5 inches to about 5.5 inches.

2. The method of claim 1 wherein the height of said male embossing elements is from between about 0.045 to about 0.06 inch.

3. The method of claim 1 wherein said calendering nip applies a pressure of from about 30 to about 200 pounds per lineal inch to said tissue web.

4. The method of claim 1 wherein the length of said tissue web within said rolled product is from about 45 to about 120 meters.

5. The method of claim 1 wherein said resilient calendering roll has a Shore A hardness of from between about 85 to about 95 Durometer.

6. The method of claim 1 wherein said calendering nip compresses said tissue web to a bulk greater than about 6 cubic centimeters per gram.

7. The method of claim 1 wherein said smooth rubber covered backing roll has a Shore A surface hardness of from between about 65 to about 85 Durometer.

8. The method of claim 1 wherein said embossing nip applies a pressure from between about 80 to about 150 pounds per lineal inch to said tissue web.

9. The method of claim 1 wherein said tissue web is unwound from a parent roll prior to entering said calendering nip and said calendering nip applies a pressure of from between about 30 to about 200 pounds per lineal inch to said tissue web.

10. A method for processing a high-bulk throughdried tissue web to form an embossed, rolled tissue product, comprising:

a) passing a throughdried tissue web having an initial caliper of about 0.008 inch or greater and a basis weight of from between about 5 to about 70 grams/square meter through a calendering nip formed by a smooth steel roll and a resilient rubber roll, said resilient roll having a Shore A surface hardness of from between about 85 to about 95 Durometer;

b) passing said calendered tissue web through an embossing nip formed between a pattern roll and a smooth rubber covered backing roll, said pattern roll having a surface with a plurality of discrete spot embossing elements separated by smooth land areas, said spot embossing elements including protruding male embossing elements having a height of at least about 0.04 inches and an area of less than 1 square inch, and said tissue web having an average surface waviness for said spot embossments of at least about 30 micrometers; and c) rewinding said tissue web into said rolled tissue product, said tissue product having a diameter of from between about 4.5 inches to about 5.5 inches.

* * * * *